United States Patent [19]

Korshunov et al.

[11] Patent Number: 4,487,250

[45] Date of Patent: Dec. 11, 1984

[54] CONTINUOUS CASTING PROCESS AND APPARATUS

[76] Inventors: Evgeny A. Korshunov, pereulok Otdelny, 5a, kv. 29, Sverdlovsk; Alexandr N. Kuznetsov, prospekt Mira, 118, kv. 49, Krasnoyarsk; Maxim B. Ovodenko, ulitsa Gorkogo, 19, kv. 5, Krasnoyarsk; Gennady G. Kuzmin, ulitsa Lebedevoi, 147a, kv. 9, Krasnoyarsk; Valery P. Kostrov, ulitsa Bazhova, 57, kv. 10, Sverdlovsk; Alexandr N. Timofeev, ulitsa Kachinskaya, 60a, kv. 3, Krasnoyarsk; Valery L. Bastrikov, ulitsa Kommunisticheskaya, 83, kv. 63; Tatyana V. Meschaninova, ulitsa Malysheva, 127a, kv. 21, both of Sverdlovsk, all of U.S.S.R.

[21] Appl. No.: 367,994

[22] Filed: Apr. 13, 1982

[51] Int. Cl.[3] ..... B22D 11/10

[52] U.S. Cl. ..... 164/473; 164/475; 164/490

[58] Field of Search ..... 164/57.1, 133, 415, 164/437, 440, 466, 473, 475, 485, 488, 490, 498, 499, 502, 439

[56] References Cited

U.S. PATENT DOCUMENTS

| | | | |
|---|---|---|---|
| 4,030,538 | 6/1977 | Carbonnel | 164/133 X |
| 4,073,333 | 2/1978 | Korshunov et al. | 164/475 |
| 4,200,143 | 4/1980 | Matteo et al. | 164/440 |

FOREIGN PATENT DOCUMENTS

| | | | |
|---|---|---|---|
| 1245049 | 7/1967 | Fed. Rep. of Germany | 164/133 |
| 19162 | of 1909 | United Kingdom | 164/440 |
| 265385 | 7/1970 | U.S.S.R. | |
| 440203 | 8/1978 | U.S.S.R. | 164/502 |

OTHER PUBLICATIONS

"Continuous Casting", by E. German, Metallurgizdat Publishers, Moscow, 1961, p. 168, Fig. 488; p. 170, Fig. 495; p. 200, Fig. 582.

"Horizontal Continuous Casting of Nonferrous Metal and Alloys" by O. A. Shatagin, V. G. Sladkoshteev et al., Metallurgizdat Publishers, Moscow, 1974, pp. 42–44, Figs. 14–16.

*Primary Examiner*—Kuang Y. Lin

*Attorney, Agent, or Firm*—Fleit, Jacobson, Cohn & Price

[57] ABSTRACT

A continuous casting process and apparatus for feeding a molten metal into a mold from a metal supply system through a metal feeding duct, effecting a stepwise withdrawal of a continuous strand or casting from the mold for a measured length and simultaneously feeding a molten metal into the latter, producing a superpressure on the forming skin of casting at the side of molten metal at intervals between the casting withdrawal cycles. On completion of the withdrawal cycle, the molten metal is fed from the metal supply system to an auxiliary vessel prefilled with an inert gas, whereupon a preset pressure is built up in the molten metal inside the auxiliary vessel and in the casting being formed. Next, the molten metal is moved to and fro between the auxiliary vessel and the metal feeding duct of the metal supply system. As the casting is withdrawn from the mold for a given length, the molten metal is concurrently fed into the mold from the auxiliary vessel and from the metal supply system.

2 Claims, 1 Drawing Figure

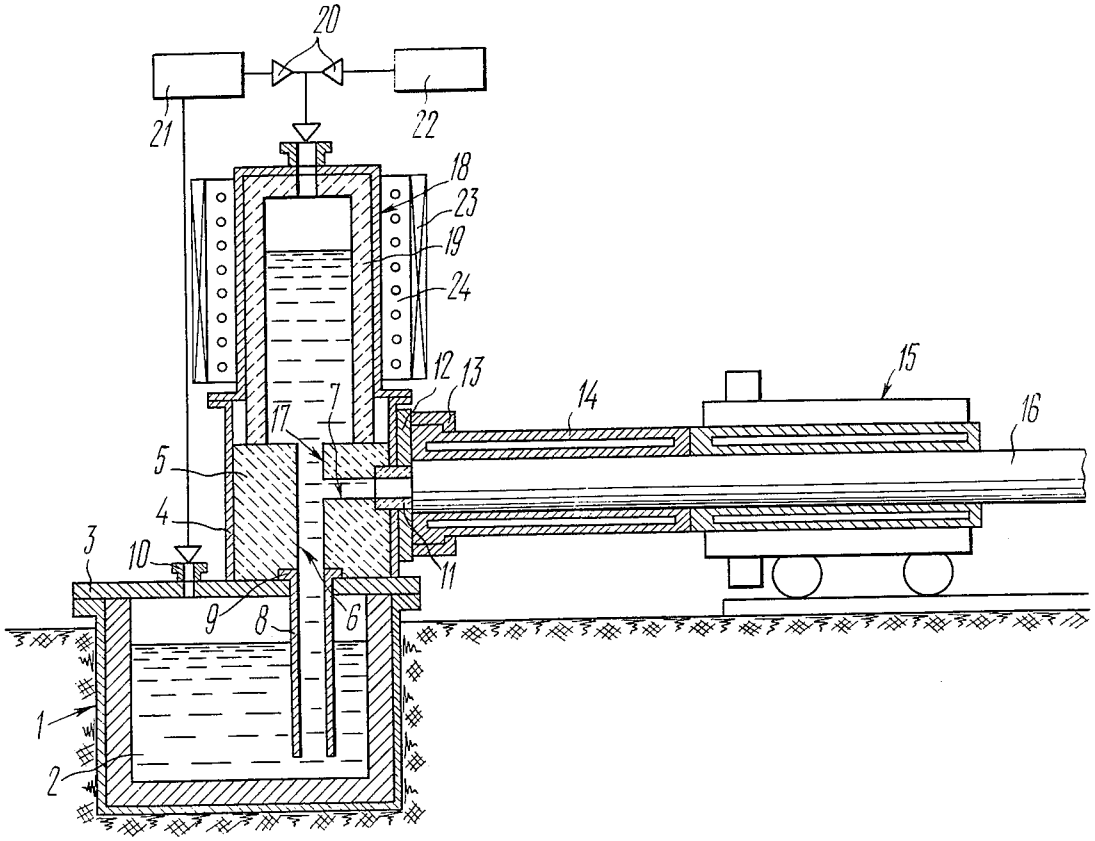
1
2
3
4
5
6
7
8
9
10
11
12
13
14
15
16
17
18
19
20
21
22
23
24

CONTINUOUS CASTING PROCESS AND APPARATUS

FIELD OF THE INVENTION

The present invention relates to metal casting and more particularly to a process and apparatus for continuous casting of metal.

The invention is well adapted to casting of various ferrous and nonferrous metals, such as light aluminium- and magnesium-base metals and alloys, when a continuously-cast section is withdrawn from the mould horizontally or at an angle to the horizontal.

BACKGROUND ART

There are known various techniques for horizontal continuous casting of metal (see a book by E. German, entitled "Continuous Casting", Metallurgizdat Publishers, Moscow, 1961, p. 168, FIG. 488; p. 170, FIG. 495; p. 200, FIG. 582), which consist in that a casting formed in a mold and a secondary-cooling zone is then withdrawn in a stepwise manner from the mold so as to be further severed to measured lengths.

A horizontal continuous-casting machine generally comprises a tundish, a cooled mold, a system for feeding molten metal into the mold, a secondary-cooling chamber, and a casting withdrawal mechanism.

The prior-art continuous casting processes are disadvantageous in that they fail to ensure the production of high-quality castings.

There is also known a process and apparatus for horizontal casting of metal (see a book by V. Shwarzmeier, entitled "Continuous Casting", Gosnauchtekhizdat Publishers, Moscow, 1962, p. 226) wherein a molten metal is fed into a horizontal mold by means of a closed sectional pipeline. The molten metal fed into the pipeline is raised to a level slightly above the mold, whereupon the metal is gravity fed into the mold to solidify therein, i.e. the casting process can be discontinued at will.

However, the above process also fails to ensure good quality of castings.

There is further known a process and apparatus for horizontal continuous casting of metal (see a book by O. A. Shatagin, V. G. Sladkoshteev et al., entitled "Horizontal Continuous Casting of Nonferrous Metals and Alloys", Metallurgizdat Publishers, Moscow, 1974, pp. 42–44, FIGS. 14–16). According to this process, a molten metal is fed into a mold from a holding furnace through a tightly closed tundish. The metal is delivered into the mold under pressure, which depends upon the height as measured from the metal meniscus to an opening in the horizontal mold. The casting formed in the mold is then withdrawn therefrom in a stepwise manner, passed through the secondary-cooling zone and finally cut to measured lengths.

The above-described process makes it impossible to control the initial stage of the casting formation or to improve the casting structure in cross section. The apparatus for performing this process is likewise unsuitable for improving the structure of the casting being produced.

There is also known a continuous casting process and apparatus as disclosed in USSR Inventor's Certificate No. 265385, which allow an overpressur to be built up in the liquid phase of the casting at intervals between the withdrawal cycles and a drop in pressure prior to the casting withdrawal operation, whereupon the casting is cooled in the secondary-cooling zone and then is cut to measured lengths. The apparatus for performing this process comprises a metal supply system including a tundish, an adapter with intercommunicating channels, a mold, a secondary-cooling chamber, a mechanism for intermittent withdrawal of the casting from the mold, and an arrangement for severing the casting into measured lengths.

The above described process and apparatus fail to ensure good quality of the cast product and make it impossible to set up favourable conditions for the formation of castings in the mold, for example, by producing pulsating pressure at the side of the molten metal on the solidifying skin of casting. Also, no provision is made for introducing a powdered material into the molten metal.

SUMMARY OF THE INVENTION

It is an object of the present invention to provide a continuous casting process and apparatus which will permit improved quality of the cast product to be obtained by producing a pulsating pressure in the molten metal of the casting being formed during reciprocating motion of the molten metal between a metal feeding duct and an auxiliary vessel.

Another object of the invention is to step up the metal casting speed by introducing a powdered material into the molten metal fed for casting.

These and other objects of the invention are accomplished by providing a continuous casting process which comprises feeding a molten metal into a mold from a metal supply system through a metal feeding duct, effecting a stepwise withdrawal of a solidifying casting for a given length from the mold while supplying a next portion of molten metal thereinto, producing a superpressure on the solidifying skin of casting at the side of molten metal at intervals between the casting withdrawal cycles, wherein, on completion of the casting withdrawal cycle, the molten metal is fed from the metal supply system into an auxiliary vessel prefilled with an inert gas and a preset pressure is built up in the molten metal inside the auxiliary vessel and in the solidifying casting, whereupon the molten metal is caused to move to and fro between the auxiliary vessel and the metal feeding duct incorporated in the metal supply system, with the molten metal being fed into the mold from the auxiliary vessel and the metal supply system during the next casting withdrawal cycle.

Prior to feeding the molten metal into the mold from the auxiliary vessel, a powdered material is preferably introduced into the metal in an amount ranging from 0.001 to 50 percent of the amount of the molten metal fed from the auxiliary vessel, and while the casting is withdrawn from the mold, a suspension of the powdered material and the molten metal is concurrently fed into the mold.

The invention also provides apparatus for performing the continuous casting process, which comprises a metal supply system with a metal feeding duct, an adapter with intercommunicating channels of which one is connected to the metal feeding duct and another one to a cooled mold, a secondary-cooling chamber with a casting withdrawal mechanism, wherein, the adapter is positioned above the metal feeding duct and has an additional channel in communication with other channels provided therein and, mounted on the adapter at the side of the additional channel, is an auxiliary vessel having a gas supply system connected thereto at its upper part.

The auxiliary vessel is suitably provided with a system for supplying a powdered material.

Preferably, the auxiliary vessel is equipped with an electric heater.

In addition, the auxiliary vessel is preferably furnished with a device for induction stirring of the molten metal and powdered material, said device being mounted externally of the auxiliary vessel on the side surface thereof.

With the continuous casting process and apparatus of the invention it becomes possible to improve the quality of the cast product, to step up the metal casting time and to enhance operating reliability of the apparatus.

BRIEF DESCRIPTION OF THE DRAWING

The invention will be further described, by way of example only, with reference to the accompanying drawing in which a single FIGURE shows a general view of an apparatus for horizontal continuous casting of metal.

DESCRIPTION OF THE PREFERRED EMBODIMENTS

The process according to the invention for continuous casting of metal is carried out as follows.

Continuous casting of metal is effected by causing the molten metal to reciprocate continuously or intermittently between a metal feeding duct and an auxiliary vessel which is prefilled with an inert gas and into which the molten metal is fed after the casting is withdrawn from a mold. In the course of the withdrawal operation the mould is replenished with the molten metal from the auxiliary vessel.

To improve the structure of the casting being formed, by way of increasing the number of solidification centers and the rate of the casting throughout solidification, prior to feeding the molten metal into the mold from the auxiliary vessel, a powdered material from aluminium alloy or iron is introduced into the metal inside the auxiliary vessel in an amount of up to 10 percent of the amount of molten metal contained in the auxiliary vessel and then a suspension of the powdered material and molten metal is introduced into the mold during the withdrawal cycle.

The invention will now be described by the following illustrative Examples.

If castings are produced, for example, from aluminium alloy.

EXAMPLE 1

With the casting diameter of 100 mm, the length of withdrawal—500 mm, the withdrawal time—3 sec, the interval—27 sec, and the pulsating pressure in the molten metal—2 atm, the number of pulsations was 10, and the casting rate—1 m/min.

EXAMPLE 2

With the casting diameter of 200 mm, the length of withdrawal—1000 mm, the withdrawal time—5 sec, the interval—25 sec, and the pulsating pressure in the molten metal—up to 2.5 atm, the number of pulsations was 10 to 15, and the casting rate—2.0 m/min.

If castings are made from the same aluminium alloy, but with addition of a powdered material.

The percentage of the solid preground material to be added into any metal being cast depends on the following factors:

1. the absence of overheating of the metal being cast;
2. the occurrence of overheating of the metal being cast;
3. the addition of a powdered material or granules.

In the absence of overheating, a powdered material is added in an amount ranging from 0.001 to 10 percent of the amount of metal, and granules are added in an amount ranging from 10 to 25 percent of the amount of metal.

In the event of overheating, a powdered material is added into the molten metal in an amount ranging from 15 to 20 percent of the amount of metal, and granules are added in an amount from 20 to 50 percent of the amount of metal.

EXAMPLE 3

With the casting diameter of 100 mm, the length of withdrawal—500 mm, the withdrawal time—3 sec, and the pulsating pressure in the molten metal of 2 atm, with no overheating of metal, a powdered material or granules were added in an amount of 10 percent of the amount of metal. This being done, the interval was 17 sec, the withdrawal rate—1.5 m/min, and the number of pulsations was 7.

The apparatus for performing the continuous casting process of the invention comprises a metal supply system, which, depending on the metal being cast, may have various embodiments.

One of the embodiments envisages the use of induction pumps by means of which molten metal is delivered to a metal feeding duct. This embodiment is not shown in the drawing.

In another embodiment use is made of a tightly closed tundish adapted to accommodate the metal feeding duct. The process and apparatus will be further described in accordance with the preferred embodiment of the invention as shown in the sole FIGURE of the above drawing.

Thus the apparatus, illustrated, comprises a tightly closed, preferably heated, tundish 1 for a molten metal 2. Mounted on a cover 3 of the tundish 1 and enclosed in a metal casing 4 is a refractory adapter 5 having a vertical channel 6 and a horizontal channel 7 communicating with each other. The tundish 1 accommodates a metal feeding duct 8 having its one end immersed in the molten metal 2 and the other end pressed against the cover 3 by the refractory adapter 5 through a flange 9 and refractory cement. The cover 3 has a tightly closed opening (not shown) through which the molten metal is fed into the tundish 1 and an opening 10 adapted to admit a compressed gas into the tundish 1.

There is provided a cooled mold 14 which is connected to the horizontal channel 7 through a refractory sleeve 11 and a packing 12 by means of a clamping ring 13. Positioned after the mold 14 is a mechanism 15 for the stepwise withdrawal of a casting 16 from the mold 14.

The refractory adapter 5 is formed with an additional channel 17 which is arranged therein coaxially with the vertical channel 6 and which communicates with the horizontal channel 7 and with an auxiliary vessel 18 mounted on the metal casing 4 of the refractory adapter 5 in alignment with the vertical channels 17 and 6. The interior surface of the auxiliary vessel 18 is lined with a refractory 19.

Connected at the top to the auxiliary vessel 18 through a change-over valve is a gas supply system 21 and a container 22 for a powdered material, incorporated in a system for feeding a precrushed solid material.

The auxiliary vessel is provided with an induction stirrer 23 for stirring the molten metal and powdered material. If necessary, the auxiliary vessel 18 is equipped with an electric heater 24. To initiate the casting process a dummy bar is required.

The continuous casting process as performed by the apparatus of the invention is carried out as follows:

1. Feeding the molten metal 2 into the tundish 1 through the tightly closed opening in the cover 3 until it reaches a preset level in the tundish 1, whereupon the latter is sealed.

2. Heating, if necessary, the auxiliary vessel 18 by means of the electric heater 24 several seconds prior to feeding the molten metal 2.

3. Introducing a dummy bar into the mold 14 by means of the casting withdrawal mechanism 15 and pressing it against the refractory sleeve 11.

4. Feeding a gas, preferably inert, from the gas supply system 21 into the tundish 1 through the opening 10 in the cover 3 and then building up an initial superpressure P sufficient to permit the molten metal 2 to pass along the metal feeding duct 8, vertical duct 6 and additional channel 17 and fill the horizontal channel 7 until the molten metal 2 comes in contact with the dummy bar and then fills the auxiliary vessel 18 until it reaches a preset level, for instance, at half the height of the auxiliary vessel 18.

The casting withdrawal mechanism is then operated to move the dummy bar for a given distance, preferably equal to a measured length of the severed casting 16. The distance of withdrawal should not exceed the length of the mold 14.

As the dummy bar is pulled out from the mold 14, the latter is filled with metal, which may be fed either from the tundish 1 or from the auxiliary vessel 18.

For the skin of casting to be formed at a new section of the casting 16, an interval between withdrawing cycles is necessary. The duration of this interval is calculated in accordance with the cross-sectional dimension of the casting 16, the distance of withdrawal and the length of the secondary-cooling zone (it has been calculated to be in the range of 10 to 60 sec).

At the initial stage of this interval, the pressure of gas in the tundish 1 is raised to a preset value $P_1$, it being up to 2–3 atm for aluminium alloys and up to 3–5 atm for steel. This creates favourable conditions for the initial formation of the skin of the casting 16, with the skin being in intimate contact with the cooled walls of the mold 14. As a result, it becomes possible to produce castings with a high-quality surface.

With the increase of gas pressure in the tundish 1 to a preset value $P_1$, the gas pressure above the metal meniscus in the auxiliary vessel 18 is raised to a value $$P_2 = P_1 - h\gamma,$$

where h is the distance between the metal meniscus in the tundish 1 and in the additional vessel 18, in cm;

$\gamma$ is the specific weight of the molten metal 2, in g/cm$^3$.

During the next period of the interval, the gas pressure is repeatedly varied either in the tundish 1, for instance, by a value of $\pm 1$ atm of the preset value (equalling 2 to 3 atm), or in the additional vessel 18 by a value $$\pm P_3 = h_1\gamma,$$

where $h_1$ is the preset distance between the upper and lower levels during rise and fall of the molten metal 2 in the additional vessel 18, in cm;

$\gamma$ is the specific weight of the molten metal, in g/cm$^3$.

Although the change of the gas pressure in the additional vessel 18 by the indicated value of $\pm 1$ atm is followed by relatively insignificant rises and falls of the molten metal 2 in the additional vessel 18 and by relatively insignificant movements of the molten metal 2 in the vertical channels 6 and 17, pulsations in the pressure acting on the solidifying skin of casting are substantial and a certain movement of the molten metal 2 occurs in the casting 16 due to bulging and shrinking of the skin under the action of pulsating pressure. The above factors are conductive to the formation of castings in cross section and, especially, to the formation of the core portion thereof.

A constant change of the gas pressure in the additional vessel 18 by a value of $\pm P_3$ leads to a continuous appreciable movement of the molten metal 2 in the vertical channels 6 and 17, which eliminates the danger of the metal freezing in the channels at intervals between the withdrawal cycles, ensures good stirring of the molten metal 2 in the tundish 1 with the resultant improvement in its chemical composition and structural uniformity, and produces, though in a smaller amount as compared to the previous example, useful pulsating pressure acting on the skin of the casting at the side of the molten metal 2.

Towards the end of the interval between the withdrawal cycles the level of the molten metal 2 in the auxiliary vessel 18 is raised to a maximum height while discharging gas from the auxiliary vessel 18 and closing the gas feeding valves 20 therein.

If the molten metal 2 is to be fed into the mould 14 from the tundish 1, the initial gas pressure P is set in the latter. When the mould 14 is fed with the molten metal 2 from the auxiliary vessel 18, the gas pressure in the tundish 1 will be equal to the atmospheric.

Then, by means of the dummy bar and later with the aid of the withdrawal mechanism 15, the casting 16 being formed is pulled out from the mold 14 for a given a length.

In order to effect appropriate treatment of the molten metal 2 to be cast, it is fed from the tundish 1 not into the mold 14 but into the auxiliary vessel 18 prior to commencing the casting withdrawal operation. As the casting 16 is withdrawn from the mold 14, the latter is concurrently replenished with the pretreated molten metal 2.

The metal treating procedure may include the steps of controlling the metal temperature conditions and adding a powdered material into the molten metal before the casting 16 is withdrawn from the mold 14. Once the molten metal 2 in the additional vessel 18 is raised to a maximum level, the valve 20 is closed to discontinue the supply of gas to the additional vessel 18 and is opened to admit into the latter a preset portion of powdered material fed from the container 22.

To effect good intermixing of the powdered material with the molten metal 2, the induction stirrer 23 is operated immediately after or simultaneously with the introduction of the powdered material to cause rotation of the resultant mixture.

The process and apparatus of the invention make it possible to reduce, for example, power capacity of the induction pump used in the supply system by feeding the molten metal into the mould from the additional vessel and from the supply system. Since a greater amount of molten metal is sometimes delivered from the additional vessel, the process and apparatus permit the use of a solid preground material.

The introduction of a powdered material into the molten metal makes it possible to reduce the metal solidification time in the casting with the resultant improvement of its structure. When the solid precrushed material is introduced into the molten metal in the form of granules, these are often heated to a temperature close to the melting temperature and thus are partially melted down. As a result, the metal solidification time in the casting is reduced and its structure is improved.

By replenishing the mold with the molten metal from the auxiliary vessel, into which the molten metal is fed prior to the casting withdrawal operation, it becomes possible to carry out an appropriate treatment of the molten metal before delivering the latter into the mold.

Continuous stirring of the molten metal in the region between the metal feeding duct and the auxiliary vessel renders it possible to make the metal being cast homogeneous in chemical composition.

In addition, the process of the invention prevents the freezing of metal in the metal feeding channels during a prolonged interval between the withdrawal cycles and also permits a useful pulsating pressure to be applied onto the solidifying skin of casting at the side of molten metal. This being a positive factor conducive to the increase in the amount of sappy structure in the casting cross section, resulting in an improved quality of the cast product.

With the use of an electric heater in the additional vessel it becomes possible to prevent the freezing of metal on the inner walls of the additional vessel, especially at a time when solid preground materials are added into the molten metal during casting of certain types of refractory metals.

The provision of a device for induction stirring of the molten metal and powdered material permits effective intermixing thereof to be carried out with a view to improving quality of the cast product.

What is claimed is:

1. A continuous casting process comprising: feeding a molten metal into a mold from a metal supply system through a metal feeding duct; effecting a stepwise withdrawal of a casting from the mold for a given length and simultaneously feeding the molten metal thereinto; producing a superpressure on the forming skin of the casting by pressurizing the molten metal at intervals between casting withdrawal cycles, feeding molten metal from the metal supply system into an auxiliary vessel prefilled with an inert gas upon completion of casting withdrawal cycle from the mold; building up a preset pressure in the molten metal inside the auxiliary vessel and in the casting being formed; causing the molten metal to move to and fro between the auxiliary vessel and the metal feeding duct of the metal supply system; feeding molten metal into the mold from the auxiliary vessel and from the metal supply system while the casting is being withdrawn from the mold for a given length.

2. A continuous casting process as claimed in claim 1, including the step of introducing into the molten metal prior to feeding the molten metal into the mold a powdered material in an amount ranging from 0.001 to 50 percent of the amount of molten metal fed from the auxiliary vessel, and feeding into the mold a suspension of the powdered material and molten metal while the casting is being withdrawn from the mold.

* * * * *